US011594360B2

(12) United States Patent
Chen et al.

(10) Patent No.: US 11,594,360 B2
(45) Date of Patent: Feb. 28, 2023

(54) ELECTROMAGNETIC APPARATUS WITH HEAT SINK STRUCTURE

(71) Applicant: PHIHONG TECHNOLOGY CO., LTD., Taoyuan (TW)

(72) Inventors: Chun-Chen Chen, Taoyuan (TW); Jian-Hsieng Lee, Taoyuan (TW); Feng-Yi Lin, Taoyuan (TW); Pang-Chuan Chen, Taoyuan (TW)

(73) Assignee: PHIHONG TECHNOLOGY CO., LTD., Taoyuan (TW)

( * ) Notice: Subject to any disclaimer, the term of this patent is extended or adjusted under 35 U.S.C. 154(b) by 451 days.

(21) Appl. No.: 16/862,534

(22) Filed: Apr. 29, 2020

(65) Prior Publication Data

US 2021/0265095 A1 Aug. 26, 2021

(30) Foreign Application Priority Data

Feb. 24, 2020 (TW) ..... 109105890

(51) Int. Cl.
*H01F 27/22* (2006.01)
*H01F 27/02* (2006.01)
*H01F 27/28* (2006.01)

(52) U.S. Cl.
CPC ..... *H01F 27/025* (2013.01); *H01F 27/22* (2013.01); *H01F 27/2876* (2013.01)

(58) Field of Classification Search
CPC ..... H01F 27/025; H01F 27/125; H01F 27/16; H01F 27/2876; H01F 27/22; H01F 27/02; H01F 27/2804; H01F 27/306; H01F 2027/2809
See application file for complete search history.

(56) References Cited

U.S. PATENT DOCUMENTS 4,543,552 A * 9/1985 Fantou ..... H01F 27/2876 336/62
4,584,551 A * 4/1986 Burgher ..... H01F 27/2876 336/62
5,097,241 A * 3/1992 Smith ..... H01F 27/2876 336/60
10,147,531 B2 * 12/2018 Rai ..... H01F 27/18

FOREIGN PATENT DOCUMENTS

CN 108962553 A * 12/2018
CN 109166697 A * 1/2019 ..... H01F 27/02
CN 109243770 A * 1/2019 ..... H01F 27/02
JP 2008186904 A * 8/2008

* cited by examiner

*Primary Examiner* — Tuyen T Nguyen
(74) *Attorney, Agent, or Firm* — WPAT, PC

(57) ABSTRACT

The present invention provides an electromagnetic apparatus with heat sink structure, comprising: metal housing, the metal housing further comprises the upper housing and the lower housing to fix the components of the electromagnetic apparatus and store the energy of the electromagnetic apparatus during operation; the electrical coil is mounted on the coil shelf and is provided with numbers of primary windings and secondary windings; the heat conductive tube is arranged in the gap of the windings for conducting the heat generated by the electrical coil to the outside of the electromagnetic apparatus. Furthermore, the conducting wire is electrically coupled to the electrical coil and transmits the input voltage and output voltage during the operation of electromagnetic apparatus.

17 Claims, 2 Drawing Sheets

100

ELECTROMAGNETIC APPARATUS WITH HEAT SINK STRUCTURE

CROSS-REFERENCE TO RELATED APPLICATIONS

The present application is based on, and claims priority from, Taiwan Application Serial Number 109105890, filed Feb. 24, 2020, the disclosure of which is hereby incorporated by reference herein in its entirety.

BACKGROUND

I. Technical Field

The present invention relates to an electromagnetic apparatus with heat sink structure, more particularly, the claimed invention proposes an electromagnetic apparatus, ensuring the heat generated during the operation of electromagnetic apparatus could be conducted to the outside effectively by installing the heat conductive material in the heat sink structure.

II. Related Arts

Electromagnetic apparatus is an essential part of power device, composed with windings and magnetic cores for energy storage, energy conversion, and electrical isolation. The application of electromagnetic apparatus mainly includes three categories: a transformer, an inductor, and a motor, almost all the power device circuit contains electromagnetic apparatus, therefore, it is the most important component in the art of electromagnetic technology. Accordingly, although the electromagnetic apparatus such as the transformer and the inductor are only small components, it still plays an indispensable role in electric vehicles, LED power supplies, photovoltaic inverters and other products. In general, the transformer is used for voltage transformation, filtering and energy storage in power device, the inductor is applied for EMI and electromagnetic compatibility issues, and the motor is an apparatus that converts electromagnetic energy into mechanical energy to drive other devices.

When electromagnetic apparatus is applied in power device, they are usually cooling-down by air cooling or hydrocooling. For instance, the Taiwan Patent I379329 described a transformer structure, which include a box-shaped housing composed by the outer case, the first side plate, the base plate, and conduit to accommodate magnetic components. In '329, the transformer comprises the primary winding and the secondary winding fixed with insulating tape, a heat conductive glue is deposited inside the transformer, the heat produced during the operation of the transformer is conducted outside by the housing or the hydrocooling device located on the first side plate. Furthermore, the Taiwan Patent I677279 disclosed a power supply device with a heat sink, including the device case, the switching module, the electromagnetic module, and the cooling fan. The accommodating space inside the device case cover the above components, wherein the air inlet, the air outlet are located on both sides of the accommodating space. The electromagnetic module includes several magnetic units, the cooling fan is arranged at the air inlet to provide an airflow for cooling down the high heating magnetic units.

However, it may not proper to introduce air cooling or hydrocooling cooling device into electromagnetic apparatus directly under some circumstances, for instance, the electromagnetic apparatus locates the position deep inside the power device, or the shape of housing structure is complex and irregular, both circumstances would make the electromagnetic apparatus hardly to contact the radiator directly, resulting in terrible cooling efficiency and bring about the huge problem related to overheating of the electromagnetic apparatus if the cooling component, such as fans, radiator, and conduit are hard to configure in the power device. Therefore, there is a demand at the current time for better cooling efficiency in electromagnetic apparatus with heat sink under the circumstance of the housing structure which is complex and irregular, making the electromagnetic apparatus in the power device could normally perform.

SUMMARY

In view of the disadvantages of the prior art, the present invention provides an electromagnetic apparatus with heat sink structure, comprising: metal housing, the metal housing further comprises an upper housing and a lower housing to fix the components of the electromagnetic apparatus and store the energy of the electromagnetic apparatus during operation, wherein the lower housing further comprising coil shelf. The electrical coil is mounted on the coil shelf and is provided with numbers of primary windings and secondary windings based on the input voltage and output voltage, the heat conductive tube with long-strip shape has a bent structure in the middle, arranged in the gap of the windings for conducting the heat generated by the electrical coil to the outside of the electromagnetic apparatus. The conducting wire is electrically coupled to the electrical coil and transmits the input voltage and output voltage during the operation of electromagnetic apparatus.

According to the content of the present invention, the upper housing further comprising the fixed shelf. As fixed structure, fixed shelf and coil shelf are coupled together while the upper housing and lower housing are connected to each other for composing the components of the electromagnetic apparatus.

Base on the embodiment of the present invention, the configuration of winding in the electrical coil is chosen from the layered winding or the cross-over winding, wherein the layered winding is twined continuously in the order of each layer along the radial direction of the coil shelf. In addition, the cross-over winding is arranged along the longitudinal direction of the coil shelf.

According to the content of the present invention, the one end of the heat conductive tube is coupled to the electrical coil, and the other end is coupled to the heat sink, radiator, or cooling fan to enhance the cooling efficiency of the heat conductive tube. In addition, the heat conductive tube inside contains cooling fluid, and the number of the heat conductive tube as aforementioned could be configured to N according to the application, where $N \geq 1$. According to one preferred embodiment of the present invention, in order to conduct the heat effectively away from the internal of the electrical coil and extend the lifetime of the cooling fluid, the ingredient of the cooling fluid could be, but not limit to water, organic solvent, copper, nickel, brass, aluminum, or the combination of the above ingredient, making the temperature cooling range of the electromagnetic apparatus could be reduced 0° C. to 30° C. during the operation.

According to the content of the present invention, the radiation fin with long-strip structure is arranged in the gap of the electrical coil and contact with the winding, the one end of the radiation fin is coupled to the heat conductive tube, increasing the cooling efficiency of the heat conductive tube. In an embodiment of the present invention, a first layer radiation fin is attached to the electrical coil, and the heat conductive tube is attached on the first layer radiation fin, then the second layer radiation fin covers the heat conductive tube to dissipate the heat, making the first layer radiation fin, heat conductive tube and the second layer radiation fin to form a multilayer stacked structure.

Base on one embodiment of the present invention, the radiation fin, the electrical coil, and the heat conductive tube are fixed on the metal housing by insulating tape.

According to the content of the present invention, in order to increase the cooling efficiency, ensuring the heat generated during the operation of electromagnetic apparatus could be conducted to the outside effectively, the heat conductive glue is deposited inside the gap of the electrical coil, wherein the conductive glue adheres both the electrical coil and heat conductive tube.

In accordance with one embodiment of the present invention, the one end of the conducting wire is coupled to the electrical coil, and the other end is coupled to the electrical source or printed circuit board (PCB). According to one preferred embodiment, the printed circuit board is the control unit as the electromagnetic apparatus applying to the transformer.

BRIEF DESCRIPTION OF THE DRAWINGS

The components, characteristics and advantages of the present invention may be understood by the detailed descriptions of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

The purpose of the present invention is aiming to address the issue, such as a electromagnetic apparatus is located into a deeper position of power device, or the shape of the of housing structure is complex and irregular, making it is difficult to configure fans, radiator, and conduit of the air cooling or hydrocooling device. The situations may cause the heat generated by the operation of electromagnetic apparatus would accumulate inside, increasing the probability of malfunction. Therefore, the present invention proposes a novel electromagnetic apparatus with improved heat sink structure, through the structure of the heat conductive tube, electrical coil, radiation fin, and heat conductive glue that could cooperate with the configuration of the metal housing, making the electromagnetic apparatus of the power device could perform the function at normal operating temperature, and improve the cooling efficiency of electromagnetic apparatus. Furthermore, the electromagnetic apparatus mentioned in the present invention could be used as, but not limit to transformer, inductor, and motor with the function such as energy conversion, energy storage, and electrical isolation. As aforementioned, the present invention is provided for illustration rather than limiting the present invention.

Figure 1:
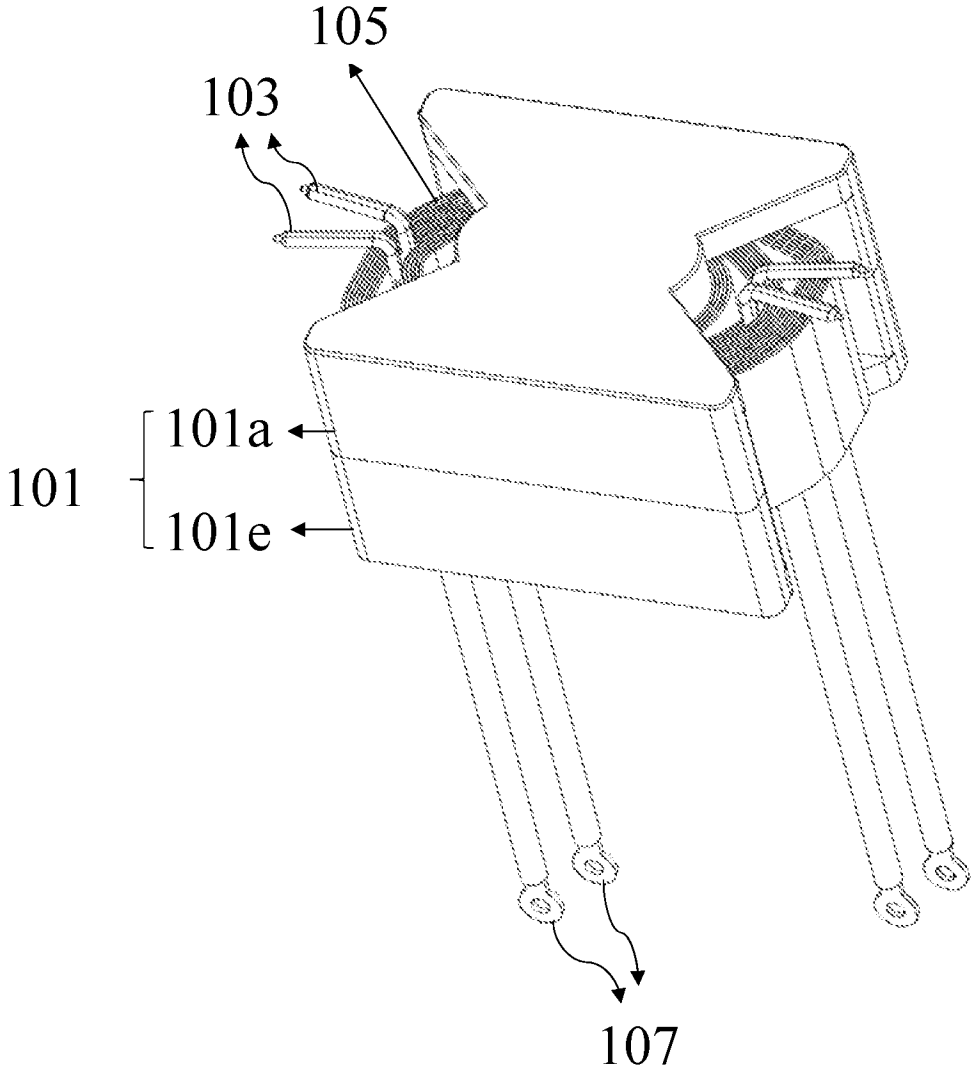
FIG. 1 illustrates the pictorial diagram of electromagnetic apparatus.
Figure 2:
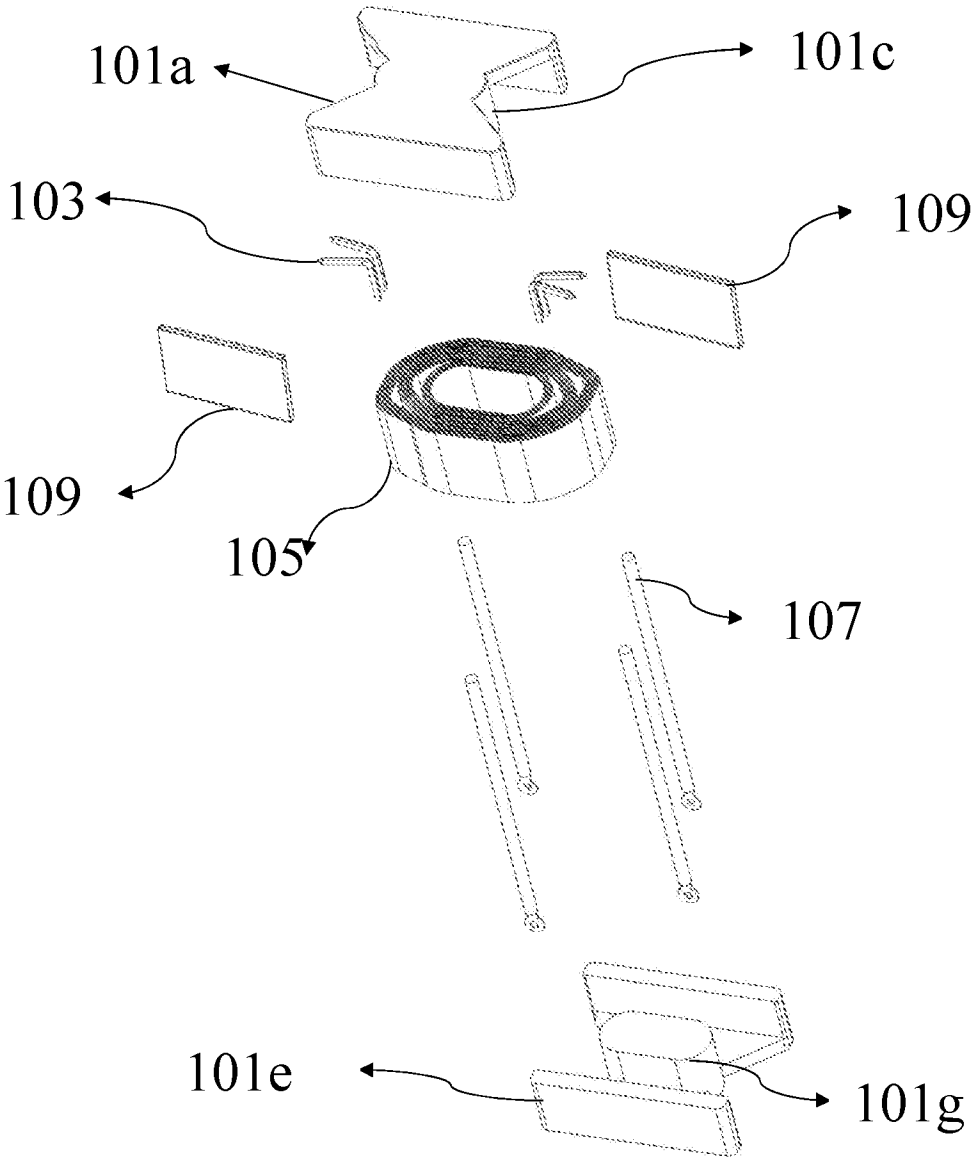
FIG. 2 illustrates the breakdown diagram of electromagnetic apparatus.

To achieve the purpose of the present invention, please refer to the pictorial diagram of electromagnetic apparatus illustrated in FIG. 1, and the breakdown diagram illustrated in FIG. 2. The present invention provides an electromagnetic apparatus 100 with heat sink structure, comprising: metal housing 101, the metal housing 101 further comprises an upper housing 101*a* and a lower housing 101*e* to fix the components of the electromagnetic apparatus 100 and store the energy of the electromagnetic apparatus 100 during operation, wherein the lower housing 101*e* further comprise coil shelf 101*g*. The electrical coil 105 is mounted on the coil shelf 101*g* and is provided with numbers of windings based on the input voltage and output voltage, the heat conductive tube 103 with long-strip shape has a bent structure in the middle, arranged in the gap of the windings for conducting the heat generated by the electrical coil 105 to the outside of the electromagnetic apparatus 100. The conducting wire 107 is electrically coupled to the electrical coil 105 and transmits the input voltage and output voltage during the operation of electromagnetic apparatus 100. In addition, the configuration of the upper housing 101*a* and the lower housing 101*e* is symmetrical to each other. While the bottom of the upper housing 101*a* is coupled with the top of the lower housing 101*e*, the metal housing 101 is formed by combining the fixed shelf 101*c* and the coil shelf 101*g*, the electrical coil 105 then is mounted between the coil shelf 101*g* and the fixed shelf 101*c*.

According to one embodiment, for the purpose of cooperating the metal housing 101 with the shape of electromagnetic apparatus in the power device, the fixed shelf 101*c* and the coil shelf 101*g* are columnar rectangle with rounded corners which located at the center of the upper housing 101*a* and the lower housing 101*e* in the viewing of top and bottom, also, the two sides of the metal housing 101 extend into a triangle structure toward outside, exposing a part of the electrical coil coil 105 to the outside of the metal housing. Accordingly, the contact area between electrical coil 105 and air is increase, leading to increase the thermal convection for improving the cooling efficiency of electromagnetic apparatus 100 of the present invention, addressing the issue that electromagnetic apparatus 100 is located into a deeper position of power device, or the shape of the of metal housing 101 structure is complex, making it difficult to configure fans, radiator, and conduit to have thermal convection or conduction of electrical coil 105.

In an embodiment of the present invention, the electrical coil 105 may have different numbers of primary windings and secondary winding based on the need of input voltage and output voltage while the electromagnetic apparatus 100 is used as the transformer, the configuration of the primary winding and the secondary winding could be chosen from the layered winding or the cross-over winding. In the embodiment, the layered winding is twined continuously in the order of each layer along the radial direction of the coil shelf 101*g*, furthermore, the cross-over winding is arranged along the longitudinal direction of the coil shelf 101*g*. In accordance with one aspect of the present invention, electrical coil 105 may choose the configuration of layered winding since said configuration has the characteristics of the better producibility and compactibility, in the other hand, the electrical coil 105 may choose the configuration of cross-over winding since said configuration has the characteristics of the better cooling efficiency.

Moreover, according to one aspect of the present invention, in order to further increase the temperature reduction range and the cooling efficiency, avoiding the temperature of electromagnetic apparatus 100 ascending substantially to affect the normal operation performance and reduce the lifetime of the electromagnetic apparatus 100 under the higher level of electrical power, the length and shape of the heat conductive tube 103 could be configured according to the needs of the application. The the one end of heat conductive tube 103 is fixed to the position of the electrical coil 105 exposed outside of the metal housing 101 by an insulating tape. The other end of heat conductive tube 103 elongates outside the position of the electromagnetic apparatus 100 in power device for connecting the heat conductive tube 103 to external fans, radiator, and heat sink. In addition, the inside of the heat conductive tube contains a cooling fluid, the ingredient of the cooling fluid could be, but not limit to water, organic solvent, copper, nickel, brass, aluminum, or the combination of the above ingredient, making the temperature cooling range of the electromagnetic apparatus 100 could be reduced 0° C. to 30° C. during the operation for enhancing the cooling efficiency.

According to one embodiment of the present invention, for making the electrical insulate of the touch surface between the heat conductive tube 103 and electrical coil 105, avoiding the electrical leakage accident while the operation of electromagnetic apparatus 100 owing to the crack of electrical coil 105, thus, the soft and insulated radiation fin 109 with long-strip structure is arranged in the gap between the electrical coil 105 and heat conductive tube 103, apart from isolating the electrical coil 105 to directly contact with the heat conductive tube 103 to avoid the possible electrical leakage accident, the characteristics of soft and flexible, making radiation fin 109 could attach the unevenness of the electrical coil 105. By increasing the contact area between the radiation fin 109 and the electrical coil 105, the cooling efficiency could be raised for conducting heat outside the electromagnetic apparatus 100 between the three of the electrical coil 105, the radiation fin 109 and the heat conductive tube 103. Base on one embodiment of the present invention, in order to fully electrical insulating the heat conductive tube 103 and the electrical coil 105, and fixing tight of the radiation fin 109 in the electromagnetic apparatus 100, a first layer radiation fin 109 is attached to the electrical coil 105, and the heat conductive tube 103 is fixed to the first layer radiation fin 109, then the second layer radiation fin 109 cover with the heat conductive tube 103, making the first layer radiation fin 109, heat conductive tube 103 and the second layer radiation fin 109 to form a multilayer stacked structure.

According to one embodiment of the present invention, under some deliberations of the present invention, the heat conductive glue is deposited inside the gap of the elements, such as electrical coil 105, the metal housing 101, the fixed shelf 101*c*, the coil shelf 101*g*, the heat conductive tube 103. For instance, when it exists the higher structural strength requirement of the electromagnetic apparatus 100, or the higher cooling efficiency performance of the electromagnetic apparatus 100 in the embodiment, the heat conductive glue would osmosis into the electromagnetic apparatus 100 during the deposit process naturally, excluding the air between the components to achieve the maximum contact area between the electrical coil 105 and the heat conductive glue. After the solidification of heat conductive glue, it could provide higher peel strength and impact strength between the components of the electromagnetic apparatus 100, increasing the cooling efficiency for conducting heat outside the electromagnetic apparatus 100. In a preferred embodiment of the present invention, the temperature cooling range of the electromagnetic apparatus 100 could be reduced 0° C. to 30° C. during the operation.

In accordance with one embodiment of the present invention, the one end of the conducting wire 107 is coupled to the electrical coil 105, and the other end is coupled to the electric source or printed circuit board (PCB). According to one preferred embodiment, the printed circuit board is the control unit as the electromagnetic apparatus 100. In this instance, the electromagnetic apparatus 100 provides the output voltage the printed circuit board is required, or an external power provide the required input voltage for the need for the operation of the electromagnetic apparatus 100.

As will be understood by persons skilled in the art, the foregoing preferred embodiment of the present invention illustrates the present invention rather than limiting the present invention. Having described the invention in connection with a preferred embodiment, modifications will be suggested to those skilled in the art. Thus, the invention is not to be limited to this embodiment, but rather the invention is intended to cover various modifications and similar arrangements included within the spirit and scope of the appended claims, the scope of which should be accorded the broadest interpretation, thereby encompassing all such modifications and similar structures. While the preferred embodiment of the invention has been illustrated and described, it will be appreciated that various changes can be made without departing from the spirit and scope of the invention.

What is claimed is:

1. An electromagnetic apparatus with heat sink structure, comprising:

a metal housing, having an upper housing and a lower housing, a fixed shelf being mounted on the upper housing, a coil shelf being mounted on the lower housing;

an electrical coil mounted on the coil shelf to transmit an input voltage and an output voltage;

at least one heat conductive tube with long-strip shape, arranged in a gap of the electrical coil, wherein a bent structure is formed on the at least one heat conductive tube, thereby conducting the heat outside the electrical coil;

at least one conducting wire, electrically coupling to the electrical coil; and at least one flexible insulated radiation fin attached to the at least one heat conductive tube and the unevenness of the electrical coil for isolating the electrical coil to contact with the heat conductive tube, thereby avoiding electrical leakage, and conducting heat outside of the electromagnetic apparatus;

wherein a bottom of the fixed shelf and a top of the coil shelf are coupled together by connecting the upper housing and the lower housing to form the metal housing, thereby mounting the electrical coil between the coil shelf and the fixed shelf such that a part of the electrical coil is exposed outside of the metal housing.

2. The electromagnetic apparatus with heat sink structure of claim 1, wherein the at least one heat conductive tube contains a cooling fluid therein.

3. The electromagnetic apparatus with heat sink structure of claim 2, wherein an ingredient of the cooling fluid is selected from water, organic solvent, copper, nickel, brass, aluminum, or the combination thereof.

4. The electromagnetic apparatus with heat sink structure of claim 1, wherein the at least one flexible insulated radiation fin is configured the at least one heat conductive tube therebetween to form a sandwich structure.

5. The electromagnetic apparatus with heat sink structure of claim 1, wherein the electromagnetic apparatus is used as a transformer.

6. The electromagnetic apparatus with heat sink structure of claim 1, wherein one end of the heat conductive tube is fixed on a position of the electrical coil exposed outside of the metal housing by an insulating tape, and the other end of the heat conductive tube elongates outside of the electromagnetic apparatus.

7. The electromagnetic apparatus with heat sink structure of claim 1, wherein a heat conductive glue is deposited inside the gap the electrical coil, the metal housing, the at least one heat conductive tube to exclude the air therebetween, providing higher peel strength and impact strength of the electromagnetic apparatus.

8. The electromagnetic apparatus with heat sink structure of claim 1, wherein the configuration of the at least one winding is layered winding, twined continuously in the order of each layer along the radial direction of the coil shelf.

9. The electromagnetic apparatus with heat sink structure of claim 1, wherein the configuration of the at least one winding is cross-over winding, arranged along the longitudinal direction of the coil shelf.

10. An electromagnetic apparatus with heat sink structure, comprising:

a metal housing, having an upper housing and a lower housing, a fixed shelf being mounted on the upper housing, a coil shelf being mounted on the lower housing, wherein the structure of the upper housing and the lower housing are symmetrical;

an electrical coil mounted on the coil shelf to transmit an input voltage and an output voltage;

at least one heat conductive tube with long-strip shape, arranged in a gap of the electrical coil, wherein a bent structure is formed on the at least one heat conductive tube, thereby conducting the heat outside the electrical coil;

at least one conducting wire, electrically coupling to the electrical coil; and at least one flexible insulated radiation fin attached to the at least one heat conductive tube and the unevenness of the electrical coil for isolating the electrical coil to contact with the heat conductive tube, thereby avoiding electrical leakage, and conducting heat outside of the electromagnetic apparatus;

wherein a heat conductive glue is deposited inside the gap of the electrical coil, the metal housing, the at least one heat conductive tube to exclude the air therebetween, providing higher peel strength and impact strength of the electromagnetic apparatus.

11. The electromagnetic apparatus with heat sink structure of claim 10, wherein the at least one heat conductive tube contains a cooling fluid therein.

12. The electromagnetic apparatus with heat sink structure of claim 11, wherein an ingredient of the cooling fluid is selected from water, organic solvent, copper, nickel, brass, aluminum, or the combination thereof.

13. The electromagnetic apparatus with heat sink structure of claim 10, wherein the at least one flexible insulated radiation fin is configured the at least one heat conductive tube therebetween to form a sandwich structure.

14. The electromagnetic apparatus with heat sink structure of claim 10, wherein the at least one radiation fin is attached on the at least one heat conductive tube to form a multilayer stacked structure.

15. The electromagnetic apparatus with heat sink structure of claim 10, wherein one end of the heat conductive tube is fixed on a position of the electrical coil exposed outside of the metal housing by an insulating tape, and the other end of the heat conductive tube elongates outside of the electromagnetic apparatus.

16. The electromagnetic apparatus with heat sink structure of claim 10, wherein the configuration of the at least one winding is layered winding, twined continuously in the order of each layer along the radial direction of the coil shelf.

17. The electromagnetic apparatus with heat sink structure of claim 10, wherein the configuration of the at least one winding is cross-over winding, arranged along the longitudinal direction of the coil shelf.

* * * * *